US008262075B2

(12) United States Patent
Shiraishi

(10) Patent No.: US 8,262,075 B2
(45) Date of Patent: Sep. 11, 2012

(54) IMAGE FORMING SYSTEM

(75) Inventor: Ryuuichi Shiraishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 113 days.

(21) Appl. No.: 12/952,914

(22) Filed: Nov. 23, 2010

(65) Prior Publication Data

US 2011/0236158 A1 Sep. 29, 2011

(30) Foreign Application Priority Data

Mar. 29, 2010 (JP) ..... 2010-076186

(51) Int. Cl.
*B65H 37/04* (2006.01)

(52) U.S. Cl. ..... 270/58.09; 270/58.08; 270/58.11

(58) Field of Classification Search ..... 270/37, 270/52.18, 58.08, 58.09, 58.11; 412/6, 18, 412/33; 399/408, 410
See application file for complete search history.

(56) References Cited

U.S. PATENT DOCUMENTS 5,508,798 A * 4/1996 Yamada ..... 399/410
5,717,843 A * 2/1998 Tabata et al. ..... 358/1.18
5,722,031 A * 2/1998 Fujii et al. ..... 399/410
6,711,365 B2 * 3/2004 Ohtani ..... 399/82
8,011,650 B2 * 9/2011 Tao et al. ..... 270/58.09

FOREIGN PATENT DOCUMENTS

JP 2000-318918 A 11/2000

* cited by examiner

*Primary Examiner* — Leslie A Nicholson, III
(74) *Attorney, Agent, or Firm* — Sughrue Mion, PLLC

(57) ABSTRACT

An image forming system includes a first supplying unit, a second supplying unit, an image forming unit, a stacking unit, first and second binding units, an obtaining unit, and a controller. The image forming unit forms images on recording materials supplied from the first or second supplying unit. The stacking unit is for stacking, as a bundle, the recording materials having the images formed thereon. The first binding unit binds, by a first binding operation, first edge portions of the bundle. The second binding unit binds, by a second binding operation, second edge portions of the bundle. The obtaining unit obtains an instruction regarding binding positions of the first and second binding operations with respect to the bundle. The controller performs control to supply the recording materials from the first or second supplying unit, on the basis of the binding positions of the first and second binding operations.

6 Claims, 12 Drawing Sheets

FIG. 10

| SYMBOL | STAPLE | EMBOSS | SHEET S | ROTATIONAL ANGLE (° ) | REVERSAL | STAPLING POSITION (Ta OR Tb) | EMBOSS POSITION (Tc OR Td) | SHEET SUPPLYING SECTION | | |
|---|---|---|---|---|---|---|---|---|---|---|
| | | | | | | | | SEF& LEF | ONLY SEF | ONLY LEF |
| (1) | TOP | BOTTOM | SEF | 0 | NO | Ta | Tc | △ | ○ | — |
| | | | LEF | 270 | NO | Tb | Td | ○ | — | ○ |
| (2) | | LEFT | SEF | 180 | YES | Ta | Td | △ | ○ | — |
| | | | LEF | 270 | NO | Tb | Tc | ○ | — | ○ |
| (3) | | RIGHT | SEF | 0 | NO | Ta | Td | ○ | ○ | — |
| | | | LEF | 270 | YES | Tb | Tc | △ | — | ○ |
| (4) | LEFT | RIGHT | SEF | 0 | NO | Tb | Td | △ | ○ | — |
| | | | LEF | 90 | NO | Ta | Tc | ○ | — | ○ |
| (5) | | TOP | SEF | 0 | YES | Tb | Tc | △ | ○ | — |
| | | | LEF | 90 | NO | Ta | Td | ○ | — | ○ |
| (6) | | BOTTOM | SEF | 0 | NO | Tb | Tc | ○ | ○ | — |
| | | | LEF | 270 | YES | Ta | Td | △ | — | ○ |
| (7) | BOTTOM | TOP | SEF | 180 | NO | Ta | Tc | △ | ○ | — |
| | | | LEF | 90 | NO | Tb | Td | ○ | — | ○ |
| (8) | | LEFT | SEF | 180 | NO | Ta | Td | ○ | ○ | — |
| | | | LEF | 90 | YES | Tb | Tc | △ | — | ○ |
| (9) | | RIGHT | SEF | 0 | YES | Ta | Td | △ | ○ | — |
| | | | LEF | 90 | NO | Tb | Tc | ○ | — | ○ |
| (10) | RIGHT | LEFT | SEF | 180 | NO | Tb | Td | △ | ○ | — |
| | | | LEF | 270 | NO | Ta | Tc | ○ | — | ○ |
| (11) | | TOP | SEF | 180 | NO | Tb | Tc | ○ | ○ | — |
| | | | LEF | 90 | YES | Ta | Td | △ | — | ○ |
| (12) | | BOTTOM | SEF | 180 | YES | Tb | Tc | △ | ○ | — |
| | | | LEF | 270 | NO | Ta | Td | ○ | — | ○ |

FIG. 11

| SYMBOL | STAPLE | EMBOSS | SHEET S | ROTATIONAL ANGLE (° ) | REVERSAL | STAPLING POSITION (Ta OR Tb) | EMBOSS POSITION (Tc OR Td) | SHEET SUPPLYING SECTION | | |
|---|---|---|---|---|---|---|---|---|---|---|
| | | | | | | | | SEF& LEF | ONLY SEF | ONLY LEF |
| (13) | TOP | BOTTOM | SEF | 270 | NO | Tb | Td | △ | ○ | — |
| | | | LEF | 0 | NO | Ta | Tc | ○ | — | ○ |
| (14) | | LEFT | SEF | 270 | NO | Tb | Tc | ○ | ○ | — |
| | | | LEF | 180 | YES | Ta | Td | △ | — | ○ |
| (15) | | RIGHT | SEF | 270 | YES | Tb | Tc | △ | ○ | — |
| | | | LEF | 0 | NO | Ta | Td | ○ | — | ○ |
| (16) | LEFT | RIGHT | SEF | 90 | NO | Ta | Tc | △ | ○ | — |
| | | | LEF | 0 | NO | Tb | Td | ○ | — | ○ |
| (17) | | TOP | SEF | 90 | NO | Ta | Td | ○ | ○ | — |
| | | | LEF | 0 | YES | Tb | Tc | △ | — | ○ |
| (18) | | BOTTOM | SEF | 270 | YES | Ta | Td | △ | ○ | — |
| | | | LEF | 0 | NO | Tb | Tc | ○ | — | ○ |
| (19) | BOTTOM | TOP | SEF | 90 | NO | Tb | Td | △ | ○ | — |
| | | | LEF | 180 | NO | Ta | Tc | ○ | — | ○ |
| (20) | | LEFT | SEF | 90 | YES | Tb | Tc | △ | ○ | — |
| | | | LEF | 180 | NO | Ta | Td | ○ | — | ○ |
| (21) | | RIGHT | SEF | 90 | NO | Tb | Tc | ○ | ○ | — |
| | | | LEF | 0 | YES | Ta | Td | △ | — | ○ |
| (22) | RIGHT | LEFT | SEF | 270 | NO | Ta | Tc | △ | ○ | — |
| | | | LEF | 180 | NO | Tb | Td | ○ | — | ○ |
| (23) | | TOP | SEF | 90 | YES | Ta | Td | △ | ○ | — |
| | | | LEF | 180 | NO | Tb | Tc | ○ | — | ○ |
| (24) | | BOTTOM | SEF | 270 | NO | Ta | Td | ○ | ○ | — |
| | | | LEF | 180 | YES | Tb | Tc | △ | — | ○ |

IMAGE FORMING SYSTEM

CROSS-REFERENCE TO RELATED APPLICATIONS

This application is based on and claims priority under 35 USC 119 from Japanese Patent Application No. 2010-076186 filed Mar. 29, 2010.

BACKGROUND

(i) Technical Field

The present invention relates to an image forming system.

SUMMARY

According to an aspect of the invention, there is provided an image forming system including a first supplying unit, a second supplying unit, an image forming unit, a stacking unit, a first binding unit, a second binding unit, an obtaining unit, and a controller. The first supplying unit supplies recording materials in a first orientation, each recording material having a long side and a short side, the first orientation being an orientation in which the short side is a front side in a transport direction. The second supplying unit supplies recording materials in a second orientation, each recording material having a long side and a short side, the second orientation being an orientation in which the long side is a front side in the transport direction. The image forming unit forms images on the recording materials supplied from the first supplying unit or the second supplying unit. The stacking unit is used to stack, as a bundle, the recording materials having the images formed thereon by the image forming unit, the bundle having the recording materials placed upon each other with first edge portions and second edge portions, differing from the first edge portions, of the respective recording materials being aligned with each other. The first binding unit binds, by a first binding operation, the first edge portions of the bundle of the recording materials stacked upon the stacking unit. The second binding unit binds, by a second binding operation, the second edge portions of the bundle of the recording materials stacked upon the stacking unit. The obtaining unit obtains an instruction regarding a binding position of the first binding operation and a binding position of the second binding operation with respect to the bundle of the recording materials. The controller performs control to supply the recording materials from either one of the first supplying unit and the second supplying unit, on the basis of the binding positions of the first and second binding operations obtained by the obtaining unit.

BRIEF DESCRIPTION OF THE DRAWINGS

Exemplary embodiments of the present invention will be described in detail based on the following figures, wherein:

FIG. 10 is a table for determining the conditions for forming vertically long images by the controller;

FIG. 11 is a table for determining the conditions for forming horizontally long images by the controller.

DETAILED DESCRIPTION

Exemplary embodiments of the present invention will hereunder be described in detail with reference to the attached drawings.

Image Forming System 1

Figure 1:
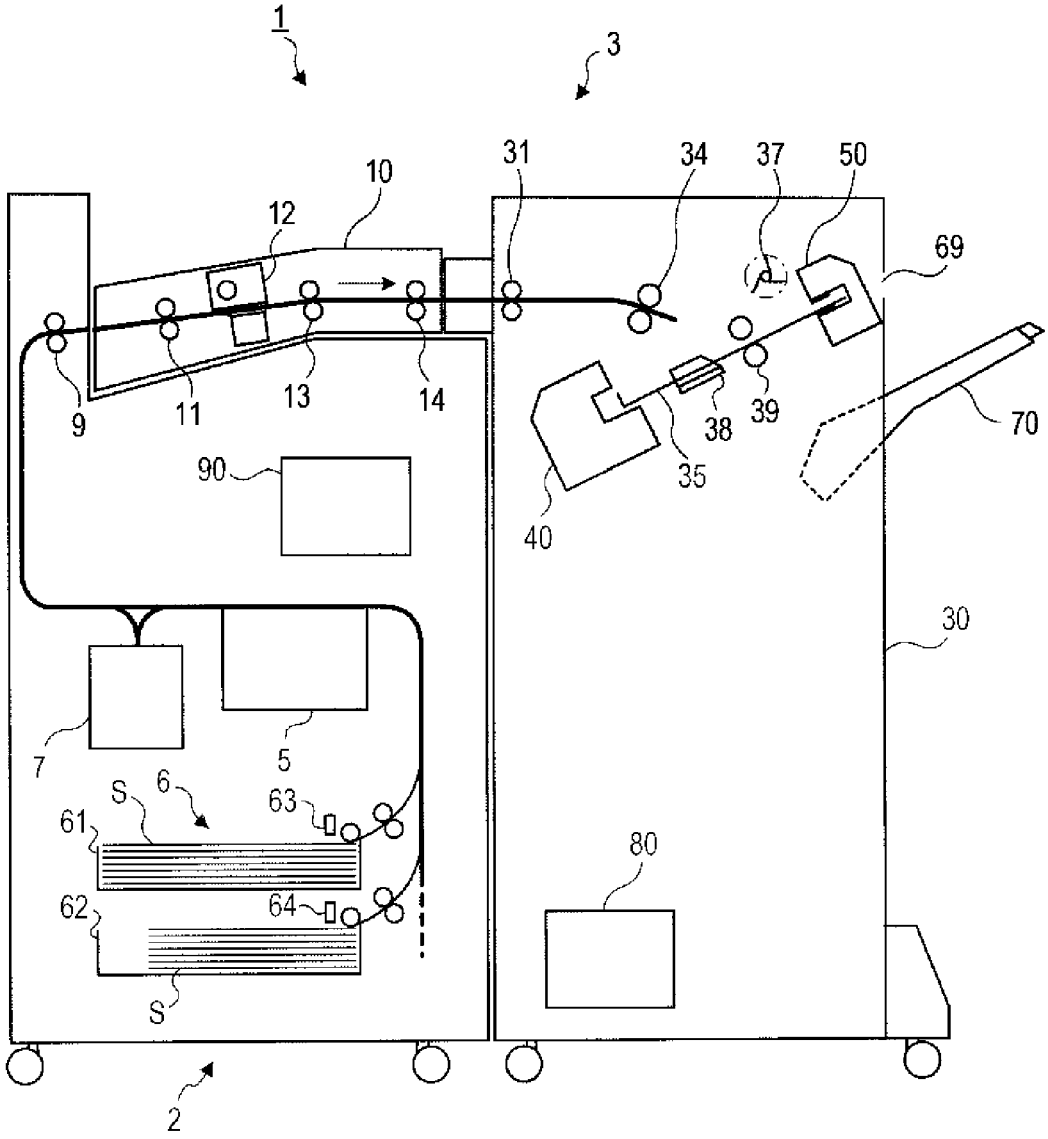
FIG. 1 is a schematic structural view of an image forming system to which an exemplary embodiment of the present invention is applied.

FIG. 1 is a schematic structural view of an image forming system 1 to which an exemplary embodiment of the present invention is applied. The image forming system 1 shown in FIG. 1 includes an image forming device 2, such as a printer and a copying machine, that forms images by electrophotography, and a sheet processing device 3 that performs a post-processing operation on a sheet S on which, for example, a toner image is formed by the image forming device 2.

Image Forming Device 2

The image forming device 2 includes a sheet supplying section 6, an image forming section 5, a sheet reversing device 7, and discharge rollers 9. The sheet supplying section 6 supplies sheets S on which images are to be formed. The image forming section 5 is an exemplary image forming unit, and forms the images on the sheets S supplied from the sheet supplying section 6. The sheet reversing device 7 is an exemplary reversing transporting unit, reverses the surfaces of the sheets S on which the images are formed by the image forming section 5, and is removable from the image forming device 2. The discharge rollers 9 discharge the sheets S on which the images are formed. The image forming device 2 also includes a user interface 90 that is an exemplary obtaining unit and that receives information regarding a binding operation from a user.

The sheet supplying section 6 includes a first sheet supplying loading section 61 (which is an exemplary first supplying unit) and a second sheet supplying loading section 62 (which is an exemplary second supplying unit), which have the sheets S loaded in the interiors thereof and which supply the sheets S to the image forming section 5. The sheet supplying section 6 also includes a first sheet supplying sensor 63 and a second sheet supplying sensor 64. The first sheet supplying sensor 63 detects whether or not there are any sheets S in the first sheet supplying loading section 61. The second sheet supplying sensor 64 detects whether or not there are any sheet S in the second sheet supplying loading section 62.

Sheet Processing Device 3

The sheet processing device 3 includes a transporting device 10 and a postprocessing device 30. The transporting device 10 transports the sheets S output from the image forming device 2 further downstream. The postprocessing device 30 includes, for example, a compiling stacking section 35 that gathers the sheets S and forms a bundle of sheets S, and a stapler 40 that binds edge portions of the sheets S. The sheet processing device 3 also includes a controller 80 that is an exemplary controller, and that controls the entire image forming system 1.

The transporting device 10 of the sheet processing device 3 includes a pair of entrance rollers 11 and a puncher 12. The entrance rollers 11 receive the sheets S output through the discharge rollers 9 of the image forming device 2. The puncher 12 punches out holes in the sheets S received from the entrance rollers 11 if necessary. The transporting device 10 also includes a pair of first transporting rollers 13 that transport the sheets S further downstream from the puncher 12, and a pair of second transporting rollers 14 that transport the sheets S towards the postprocessing device 30.

The postprocessing device 30 of the sheet processing device 3 includes a pair of receiving rollers 31 that receive the sheets S from the transporting device 10. The postprocessing device 30 also includes the compiling stacking section 35 and a pair of exit rollers 34. The compiling stacking section 35 is an exemplary stacking unit, is provided downstream from the receiving rollers 31, and gathers and holds the sheets S. The exit rollers 34 discharge the sheets S towards the compiling stacking section 35. The postprocessing device 30 further includes a paddle 37 that rotates so as to push the sheets S to an end guide 35*b* (described later) of the compiling stacking section 35. Still further, the postprocessing device 30 includes a tamper 38 for pushing the sheets S to a side guide 35*c* (described later) of the compiling stacking section 35. Still further, the postprocessing device 30 includes eject rollers 39 which hold the sheets S gathered and stacked at the compiling stacking section 35 and which transport the bound bundle of sheets S downstream.

Still further, the postprocessing device 30 includes the stapler 40 and a needleless binding device 50. The stapler 40 is an exemplary first binding unit that binds the edge portions of the bundle of sheets S gathered and stacked at the compiling stacking section 35, and binds the edge portions with wire staples 41 (see FIG. 6). The needleless binding device 50 is an exemplary second binding unit, and binds the edge portions of the bundle of sheets S without using the wire staples 41. The postprocessing device 30 has an opening 69 and a stacker 70. The opening 69 is used for discharging the bundle of sheets S. The stacker 70 is used for stacking the bundle of sheets after the postprocessing so as to allow a user to easily take the bundle of sheets.

Structure of Vicinity of Binding unit

Figure 2:
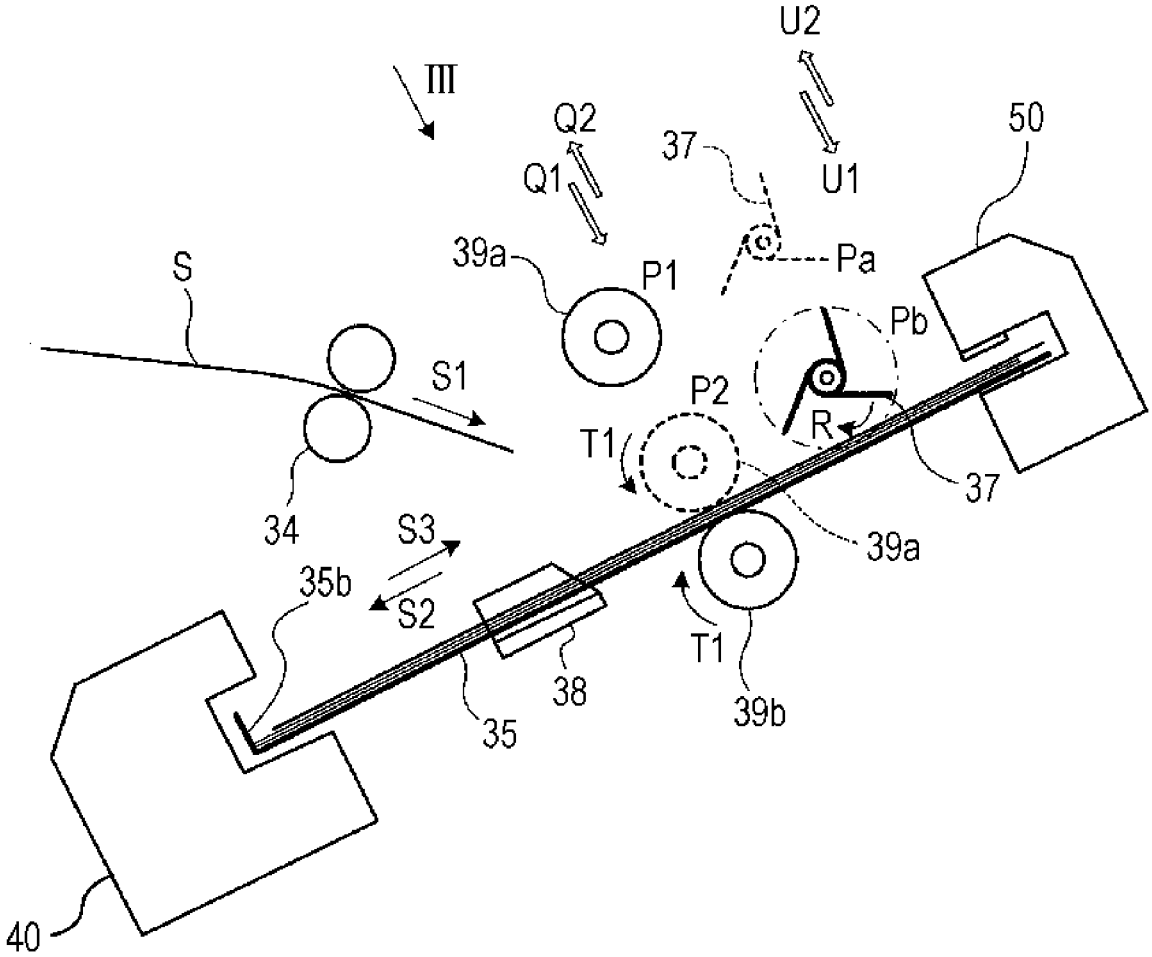
FIG. 2 is a schematic structural view of the vicinity of a compiling stacking section.
Figure 3:
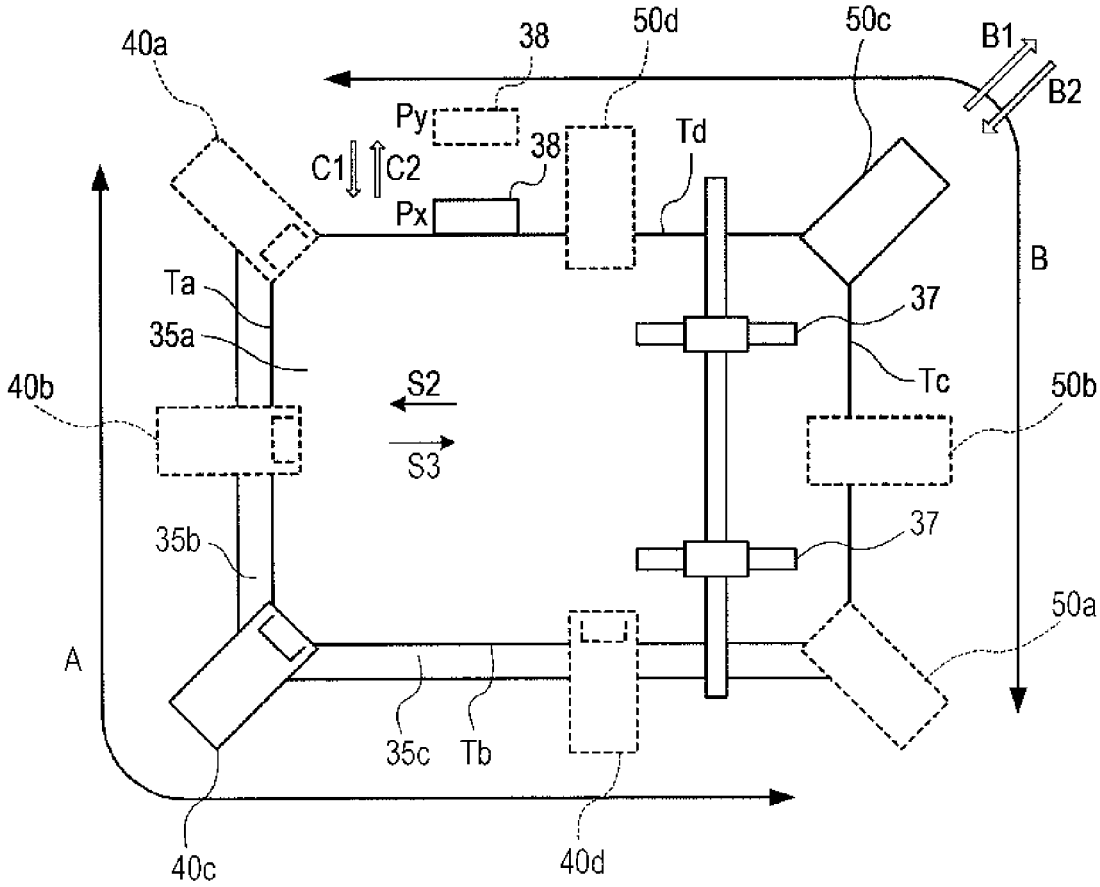
FIG. 3 is a schematic structural view of the vicinity of the compiling stacking section as viewed from the direction of arrow III shown in FIG. 2.

Next, with reference to FIGS. 2 and 3, the compiling stacking section 35, and the stapler 40, the needleless binding device 50, etc., provided in the vicinity of the compiling stacking section 35, will be described. Here, FIG. 2 is a schematic structural view of the vicinity of the compiling stacking section 35, and FIG. 3 is a schematic structural view of the vicinity of the compiling stacking section 35 as viewed from the direction of arrow III shown in FIG. 2. The lower side in FIG. 3 is a front side in a sheet plane of FIG. 1. In FIG. 3, for the sake of simplicity, some of the members, such as the eject rollers 39, are not shown.

First, the compiling stacking section 35 has a bottom portion 35*a*, the end guide 35*b*, and the side guide 35*c*. The bottom portion 35*a* has an upper side on which the sheets S are stacked. The end guide 35*b* and the side guide 35*c* are provided along the periphery of the bottom portion 35*a*. Although described in detail later, the sheets S at the vicinity of the compiling stacking section 35 are first supplied towards the compiling stacking section 35 (refer to a first traveling direction S1 in FIG. 2), and then, the traveling direction is reversed so that the sheets S drop along the bottom portion 35*a* of the compiling stacking section 35 (refer to a second traveling direction S2 in FIG. 2). Then, the traveling direction is reversed again so that the sheets S are raised along the bottom portion 35*a* of the compiling stacking section 35 (refer to a third traveling direction S3 in FIG. 2).

The structure of the end guide 35*b* and the structure of the side guide 35*c* are as follows when the structures are described using their positional relationships with the sheet S.

That is, the end guide 35*b* is disposed at the front edge of the sheet S that is transported along the second traveling direction S2. The side guide 35*c* is disposed at one of the side edges of the sheet S that is transported along the second traveling direction S2. In other words, the end guide 35*b* is formed so that front edge portions in the traveling direction of the sheets S that fall along the bottom portion 35*a* are aligned. The side guide 35*c* is formed so that side edge portions of the sheets S at one side that are substantially parallel to the falling direction of the sheets S that fall along the bottom portion 35*a* are aligned. In the exemplary embodiment, the term "substantially orthogonal" also refers to "orthogonal", and the term "substantially parallel" also refers to "parallel".

Here, as shown in FIG. 3, each edge portion of the bottom portion 35*a* of the compiling stacking section 35 in the exemplary embodiment are defined as follows.

That is, if each edge portion of the bottom portion 35*a* of the compiling stacking section 35 in the exemplary embodiment is defined in relation with the second traveling direction S2 that is the direction in which the sheets S fall along the top surface of the bottom portion 35*a* of the compiling stacking section 35, the edge portion at the front side in the second traveling direction S2 of the bottom portion 35*a* is called an end guide edge portion Ta. The end guide edge portion Ta is an edge portion that contacts the end guide 35*b*.

Next, the edge portion opposing the end guide edge portion Ta, that is, the edge portion at the back side in the second traveling direction S2 of the bottom portion 35*a* is called an opposing end guide edge portion Tc.

The edge portion extending in the second traveling direction S2 and provided at a side where the side guide 35*c* is provided is called a side guide edge portion Tb. The side guide edge portion Tb contacts the side guide 35*c*.

The edge portion opposing the side guide edge portion Tb, that is, the edge portion extending in the second traveling direction S2 and provided at a side opposite to the side where the side guide 35*c* is formed is called an opposing side guide edge portion Td.

The paddle 37 is provided above the compiling stacking section 35, and downstream in the first traveling direction S1 of the sheet S from the exit rollers 34. The paddle 37 is provided so that its distance from the bottom portion 35*a* of the compiling stacking section 35 changes when the paddle 37 is driven by a motor or the like. More specifically, the paddle 37 is provided so as to be movable in the direction of arrow U1 and the direction of arrow U2 in FIG. 2. The paddle 37 is formed so that, when it rotates in the direction of arrow R in FIG. 2, the sheet S transported along the first traveling direction S1 in FIG. 2 is pushed in the second traveling direction S2 at the compiling stacking section 35.

The tamper 38 is provided a side surface of the compiling stacking section 35, more specifically, at a side surface of the opposing side guide edge portion Td, so that its distance from the side guide 35*c* of the compiling stacking section 35 changes. The tamper 38 is provided so as to be movable in the direction of arrow C1 and the direction of arrow C2 in FIG. 3.

The eject rollers 39 include a first eject roller 39*a* and a second eject roller 39*b*. The first eject roller 39*a* and the second eject roller 39*b* are disposed so as to oppose each other with the bottom portion 35*a* of the compiling stacking section 35 being disposed therebetween. In addition, the eject rollers 39 are formed so that their distances from the sheet S that is supplied between the first eject roller 39*a* and the second eject roller 39*b* change. More specifically, the first eject roller 39*a* is provided so as to be movable in the direction of arrow Q1 and the direction of arrow Q2. In contrast, the second eject roller 39*b* is provided so that its position is fixed and so that it only rotates. The eject rollers 39 rotate in the direction of arrows T1 shown in FIG. 2 so that a bundle of sheets S bound by the stapler 40 and the needleless binding device 50 (described later) is transported in the third traveling direction S3 at the compiling stacking section 35.

Stapler 40

The stapler 40 is formed so that, by pushing the wire staples 41 one by one into the sheets S, the edge portions of the bundle of sheets S held by the compiling stacking section 35 are bound. The stapler 40 is provided so as to be movable in the vicinity of the compiling stacking section 35. More specifically, the stapler 40 is provided so as to be movable along a stapler rail (not shown) provided in the vicinity of the compiling stacking section 35 (refer to a double-headed arrow A in FIG. 3). In addition, the stapler 40 is formed so as to move on the stapler rail by a stapler motor (not shown) serving as a driving source. The stapler 40 is capable of being disposed at a user side (the lower side in FIG. 3), and is formed so as allow the user to easily perform operations on the stapler 40, such as replenishing the stapler 40 with the wire staples 41.

The stapler rail has a portion extending substantially parallel to the longitudinal direction (the up-down direction in FIG. 3) of the end guide 35*b* of the compiling stacking section 35, a portion extending substantially parallel to the longitudinal direction (the horizontal direction in FIG. 3) of the side guide 35*c*, and corners connecting these portions. Accordingly, as shown in FIG. 3, the stapler 40 is capable of performing stapling at the end guide edge portion Ta and the side guide edge portion Tb, and arbitrarily change a stapling position at each edge portion (refer to reference numerals 40*a* to 40*d* in FIG. 3). In the exemplary embodiment, the position of the stapler rail is fixed with respect to the compiling stacking section 35. In the exemplary embodiment, the home position of the stapler 40 is a position (refer to reference numeral 40*c*) where the wire staple 41 is pushed in at the corner connecting the portion extending substantially parallel to the longitudinal direction of the end guide 35*b* and the portion extending substantially parallel to the longitudinal direction of the side guide 35*c*.

Needleless Binding Device 50

The needleless binding device 50 is formed so that the edge portions of the bundle of sheets S held by the compiling stacking section 35 are bound without using the wire staples 41 (discussed later). In addition, the needleless binding device 50 is provided so as to be movable in the vicinity of the compiling stacking section 35. More specifically, the needleless binding device 50 is provided so as to be movable (refer to the directions of arrows B in FIG. 3) on a needleless-binding-device rail (not shown) provided in the vicinity of the compiling stacking section 35. The needleless binding device 50 is formed so as to move on the needleless-binding-device rail by a needleless binding-device motor (not shown) serving as a driving source. Unlike the stapler 40, the needleless binding device 50 need not be replenished with the wire staples 41.

The needleless-binding-device rail has a portion extending substantially parallel to the longitudinal direction (the up-down direction in FIG. 3) of the edge portion of the compiling stacking section 35 opposing the end guide 35*b* provided at the compiling stacking section 35, a portion extending substantially parallel to the longitudinal direction (the horizontal direction in FIG. 3) of the edge portion of the compiling stacking section 35 opposing the side guide 35*c*, and corners connecting these portions. Accordingly, as shown in FIG. 3, the needleless binding device 50 is capable of binding the bundle of sheets S at the opposing end guide edge portion Tc and the opposing side guide edge portion Td, and arbitrarily changing a binding position at each edge portion (refer to reference numerals 50*a* to 50*d* in FIG. 3). In the exemplary embodiment, the home position of the needleless binding device 50 is a position (refer to reference numeral 50*c*) where the edge portions of the bundle of sheets S are bound at the corner connecting the portion extending substantially parallel to the longitudinal direction of the edge portion of the compiling stacking section 35 and the portion extending substantially parallel to the longitudinal direction of the edge portion of the compiling stacking section 35 opposing the side guide 35*c*.

The position of the needleless-binding-device rail (not shown) may be changed in accordance with the orientation and size of the sheets S supplied to the compiling stacking section 35. More specifically, the needleless-binding-device rail is movable so that the distance between the needleless-binding-device rail and the end guide 35*b* or the distance between the needleless-binding-device rail and side guide 35*c* is changed (refer to arrows B1 and B2 in FIG. 3).

Figure 4A:
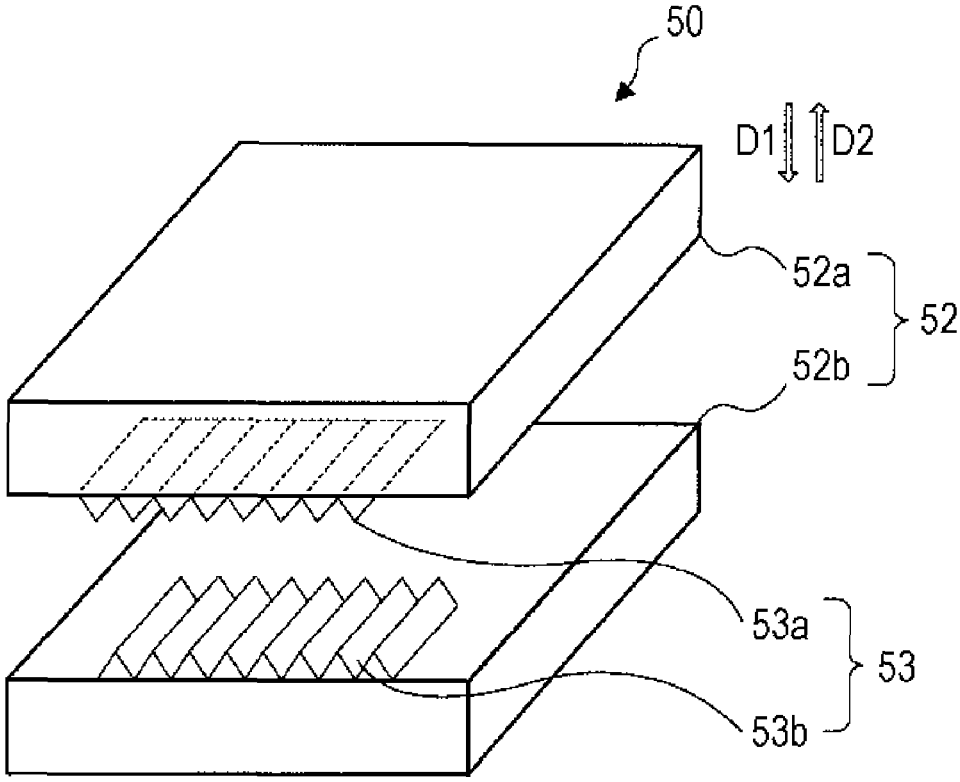
FIG. 4A is a schematic structural view of a needleless binding device.
Figure 4B:
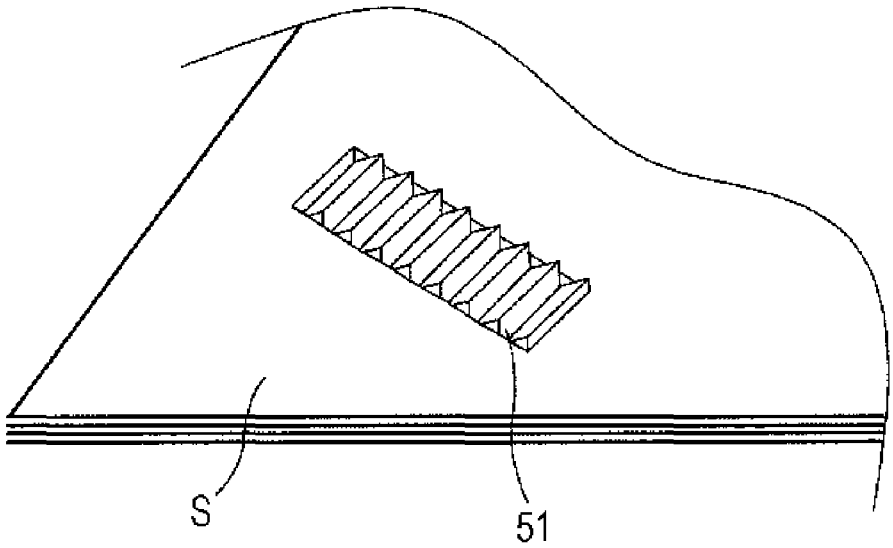
FIG. 4B is a conceptual view of an embossed portion formed by the needleless binding device.

Next, the structure of the needleless binding device 50 will be described in more detail with reference to FIGS. 4A and 4B. Here, FIG. 4A is a schematic perspective view of the needleless binding device 50, and FIG. 4B shows a corner of the bundle of sheets S whose edge portions are processed by the needleless binding device 50.

The needleless binding device 50 has a pressing portion 52 and an embossing portion 53. The pressing portion 52 applies pressure for processing an edge portion of each sheet S by advancing towards the embossing portion 53. The embossing portion 53 embosses the sheets S so that the bundle of sheets S is bound as a result of receiving the pressure from the pressing portion 52.

The pressing portion 52 includes an upper pressing portion 52*a* and a lower pressing portion 52*b*. The upper pressing portion 52*a* is provided so as to be capable of advancing towards and retreating from the lower pressing portion 52*b* by an upper-pressing-portion motor (not shown) (refer to arrows D1 and D2 in FIG. 4A). The pressing portion 52 is formed so that pressure is applied to the sheets S disposed between the upper pressing portion 52*a* and the lower pressing portion 52*b*.

The embossing portion 53 includes a protruding portion 53*a* and a receiving portion 53*b*. The protruding portion 53*a* is provided at the upper pressing portion 52*a*, and the receiving portion 53*b* is provided at the lower pressing portion 52*b*.

The protruding portion 53*a* and the receiving portion 53*b* are formed so that the sheets S provided therebetween are processed.

More specifically, the protruding portion 53*a* has a bumpy portion formed at a surface opposing the receiving portion 53*b*. The receiving portion 53*b* has a bumpy portion formed at a surface opposing the protruding portion 53*a*. The surface where the bumpy portion of the protruding portion 53*a* is formed and the surface where the bumpy portion of the receiving portion 53*b* is formed are substantially parallel to each other; and are disposed so the protrusions of the protruding portion 53*a* and the recesses of the receiving portion 53*b* engage each other. By engaging the protruding portion 53*a* and the receiving portion 53*b* with each other when the embossing portion 53 receives the pressure from the pressing portion 52, the sheets S are processed. As shown in FIG. 4B, a portion of the sheet S that is processed is an embossed portion 51 that is an exemplary bumpy portion corresponding to the shapes of the protruding portion 53*a* and the receiving portion 53*b* and provided on both sides of an axis extending in the direction in which the sheets S overlap each other; and that binds the bundle of sheets S without using the wire staples 41.

Relationship Between the Stapler 40 and the Needleless Binding Device 50

Here, in the exemplary embodiment, the stapler 40 and the needleless binding device 50 are such that the positions where they bind the edge portions of the sheets S do not overlap each other. As shown in FIG. 3, this is based on the fact that a movable range of the stapler 40 (refer to the double-headed arrow A in FIG. 3) and a movable range of the needleless binding device 50 do not overlap each other. That is, since the needleless binding device 50 is not capable of being disposed in the range in which the stapler 40 is capable of being disposed, and the stapler 40 is not capable of being disposed in the range in which the needleless binding device 50 is capable of being disposed, the positions where the stapler 40 binds the bundle of sheets S and the positions where the needleless binding device 50 binds the bundle of sheets S do not overlap.

Sheet S

The sheets S in the exemplary embodiment are rectangular sheets (including square sheets), with two long sides, two short sides, a front surface, and a back surface. Here, among the surfaces of a sheet S, the front surface of the sheet S refers to a surface on which an image is formed and the back surface of the sheet S refers to a surface at the reverse side of the surface on which an image is formed. The front surface of a sheet S when images are formed on both surfaces of the sheet S is a surface where an image is formed last.

Figure 5A:
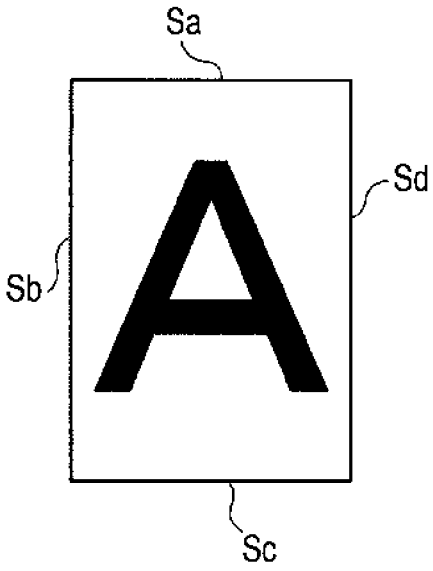
FIGS. 5A and 5B illustrate the relationship between a vertically long image and a sheet and a horizontally long image and a sheet, respectively.
Figure 5B:
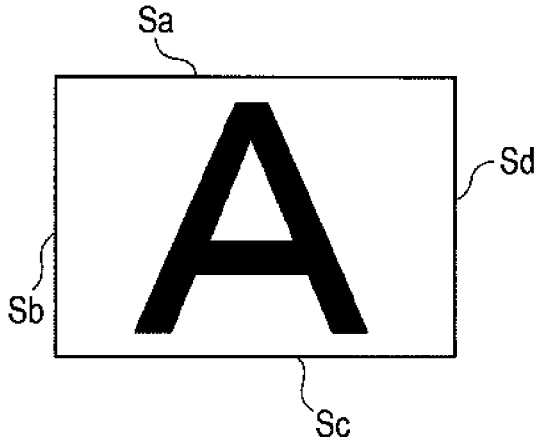
Figure 5C:
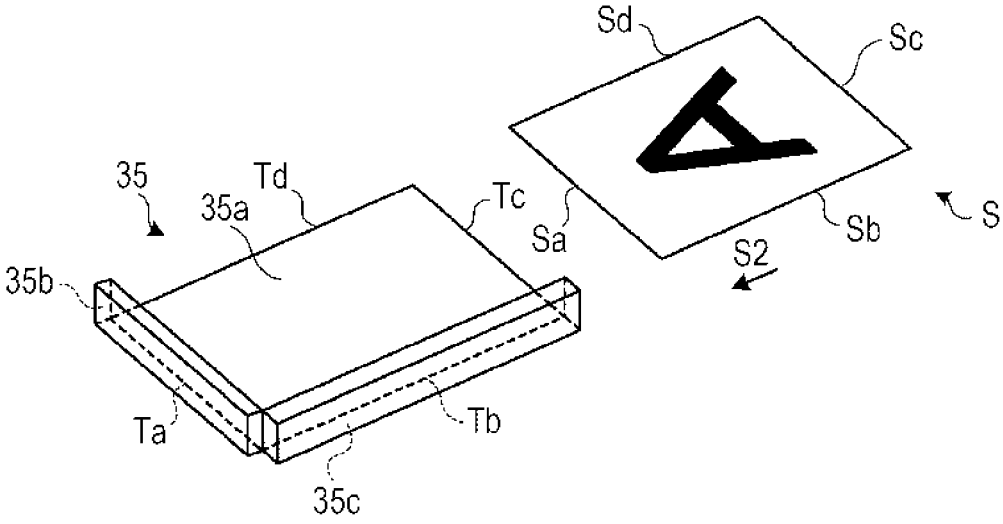
FIG. 5C is a conceptual view illustrating the relationship between a sheet on which an image is formed and the compiling stacking section.

Next, with reference to FIGS. 5A to 5C, edge portions Sa to Sd of sheets S on which images are formed, and the relationships between the edge portions Sa to Sd of these sheet S and the edge portions Ta to Td of the bottom portion 35*a* of the compiling stacking section 35 will be described. FIGS. 5A and 5B illustrate the relationship between a vertically long image and the sheet S and a horizontally long image and the sheet S. FIG. 5C is a conceptual view illustrating the relationship between the sheet S on which the image is formed and the compiling stacking section 35.

First, the definitions of the edge portions of the sheets S on which the images are formed will be explained with reference to FIGS. 5A and 5B. Here, the case in which the alphabet A is formed as an image on each sheet S will be used to explain the definitions. FIG. 5A shows a case in which what is called a vertically long image is formed with a short side of the sheet S disposed at the top portion of the image. FIG. 5B shows a case in which what is called a horizontally long image is formed, with a long side of the sheet S disposed at the top portion of the image.

As shown in each of FIGS. 5A and 5B, in the sheet S having the image formed thereon, an edge portion of the sheet S above the image is called the top edge portion Sa. An edge portion of the sheet S below the image is called the bottom edge portion Sc. An edge portion of the sheet S on the left of the image is called the left edge portion Sb. An edge portion of the sheet S on the right of the image is called the right edge portion Sd.

In the exemplary embodiment using the vertically long image shown in FIG. 5A, the top edge portion Sa and the bottom edge portion Sc are at the short sides of the sheet S. In the exemplary embodiment using the horizontally long image shown in FIG. 5B, the long sides of the sheet S are at the top edge portion Sa and the bottom edge portion Sc. Accordingly, the top edge portion Sa and the bottom edge portion Sc may be at the long side or at the short side.

Next, with reference to FIG. 5C, the relationship between the edge portions Ta to Td of the bottom portion 35*a* of the compiling stacking section 35 and the edge portions Sa to Sd of the sheet S when the sheet S is supplied to the compiling stacking section 35 will be described using an example. Here, although, the case in which the vertically long image is formed on the sheet S as shown in FIG. 5A will be described, the same applies to the case in which the horizontally long image is formed on the sheet S.

First, as shown in FIG. 5C, in the second traveling direction S2 of the sheet S, that is, in the direction in which the sheet S falls along the top surface of the bottom portion 35*a* of the compiling stacking section 35, an edge portion at the front side in the second traveling direction is the top edge portion Sa. The back surface of the sheet S contacts the bottom portion 35*a* of the compiling stacking section 35.

When the sheet S is stacked on the compiling stacking section 35, the top edge portion Sa of the sheet S is disposed at the side of the end guide edge portion Ta. The left edge portion Sb of the sheet S is disposed at the side of the side guide edge portion Tb. The bottom edge portion Sc of the sheet S is disposed at the side of the opposing end guide edge portion Tc. The right edge portion Sd of the sheet S is disposed at the opposing side guide edge portion Td.

In the exemplary embodiment shown in FIGS. 5A to 5C, the relationship between the edge portions Sa to Sd of the sheet S and the edge portions Ta to Td of the bottom portion 35*a* of the compiling stacking section 35 is as described above. However, this relationship changes in accordance with the sheets S (and the images on the sheet S) supplied to the compiling stacking section 35. For example, by changing the orientation of the sheets S, the relationship between the edge portions Sa to Sd of the sheets S and the edge portions Ta to Td of the bottom portion 35*a* of the compiling stacking section 35 changes (described in detail later).

Operation of the Image Forming System 1

Next, the operation of the image forming system 1 will be described with reference to FIGS. 1 to 9.

Here, first, after describing a basic operation mode of the image forming system 1 with reference to FIGS. 1 to 5C, the details of operational modes of the image forming system 1 will be described with reference to FIGS. 6(1) to 11 along with FIGS. 1 to 5C.

Figure 6:
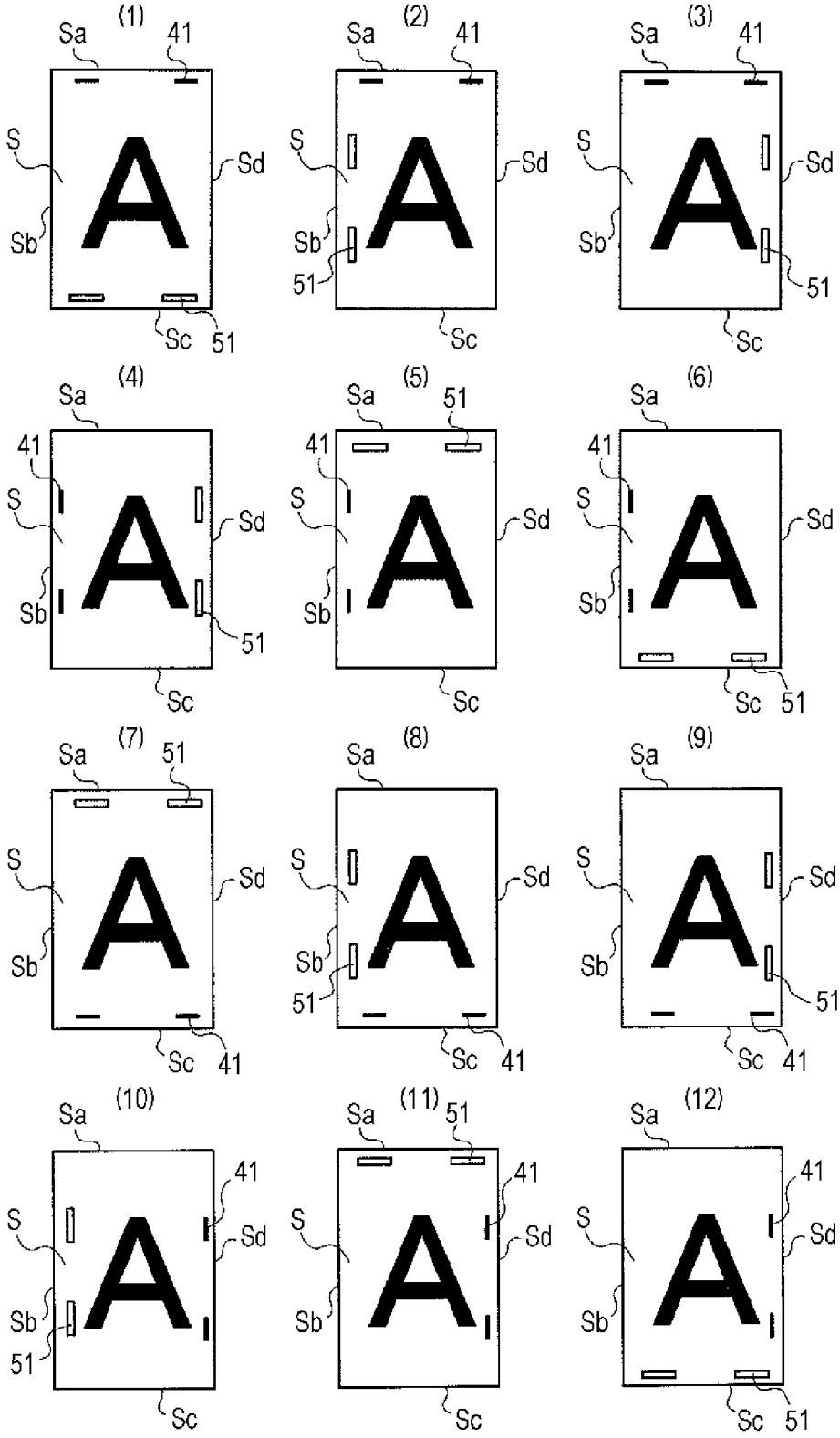
FIGS. 6(1) to 6(12) are each a conceptual view of a bundle of sheets to which vertically long images are formed by processing according to an exemplary embodiment of the present invention.
Figure 7:
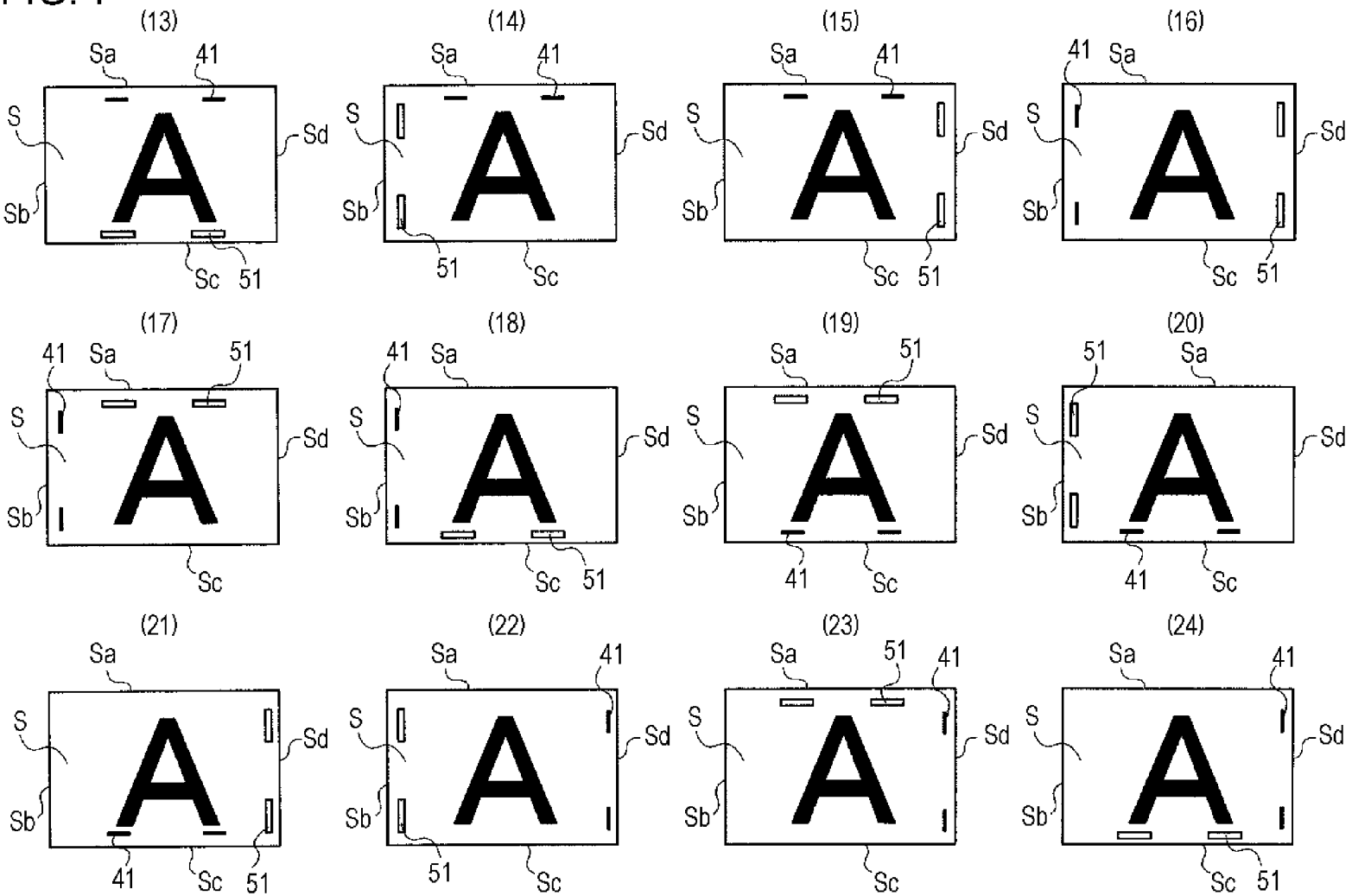
FIGS. 7(13) to 7(24) are each a conceptual view of a bundle of sheets to which horizontally long images are formed by processing according to an exemplary embodiment of the present invention.

FIGS. 6(1) to 6(12) show examples in which various binding operations are performed on a bundle of sheets S having vertically long images formed thereon. FIGS. 7(13) to 7(24) show examples in which various binding operations are performed on a bundle of sheets S having horizontally long images formed thereon. FIGS. 8A to 8H are conceptual views illustrating the orientations of the images formed on the sheets S supplied to the compiling stacking section 35 as viewed from above the compiling stacking section 35. FIG. 9 is a flowchart illustrating the steps of setting a binding operation and an image forming operation by the controller 80. FIG. 10 is a table for determining the conditions for forming vertically long images by the controller 80. FIG. 11 is a table for determining the conditions for forming horizontally long images by the controller 80.

In the exemplary embodiment, in a state in which the sheets S are stacked on the compiling stacking section 35, a state in which the front surface of the sheet S is capable of being seen from above the compiling stacking section 35 (that is, from the direction of the arrow III in FIG. 2) is called a face-up state. For example, states shown in FIGS. 5A to 5C and FIGS. 8A to 8D are called face-up states.

In contrast, in the state in which the sheets S are stacked on the compiling stacking section 35, a state in which the front surface of the sheet S cannot be viewed from above the compiling stacking section 35 is called a face-down state. For example, states shown in FIGS. 8E to 8H are face-down states.

The basic operation mode of the image forming system 1 will be described.

First, the user interface 90, provided at the image forming system 1, receives information regarding binding operations from a user. Here, exemplary items of information regarding the binding operations received from the user are as follows. That is, for example, an instruction regarding the number of sheets in a bundle of sheets S for images to be formed on the sheets S, an instruction regarding which binding unit to use to bind which edge portions of the bundle of sheets S, and an instruction regarding at which position of an edge portion of each sheet S a binding position is situated are obtained.

Next, before the controller 80 performs an image forming operation and a binding operation, the controller 80 sets the image forming operation and the binding operation.

The flowchart of setting the image forming operation and the binding operation will be described with reference to FIG. 9. First, the controller 80 obtains image formation data of images that a user wants to form on a sheet S (Step S101). Here, the image formation data that the controller 80 obtains includes, in addition to data of the images themselves that are to be formed on the sheets S, information regarding the orientations of the sheets S on which the images are to be formed, such as the short side of each sheet S being at the top (that is, the orientation for a vertically long image), or the long side of each sheet S being at the top (that is, the orientation for a horizontally long image).

Next, through the first sheet supplying sensor 63 and the second sheet supplying sensor 64, the controller 80 obtains a signal regarding the presence/absence of sheets S loaded in the first sheet supplying loading section 61 and the second sheet supplying loading section 62 (Step S102). Thereafter, the user interface 90 obtains instructions received from the user, that is, the instruction regarding the number of sheets S in a bundle to be bound and the number of sheets S in the bundle (Step S103), the instruction regarding which position of an edge portion of each sheet S is to be bound with which binding unit (Step S104), and the instruction regarding whether the sheets S are to be set in a face-up state or a face-down state (Step S105).

On the basis of the items of information obtained in Steps S101 to S105, first, the controller 80 determines whether or not it is appropriate to perform a binding operation on a bundle of sheets S in terms of the obtained binding instructions (Step S106). Here, an instruction indicating that it is not appropriate to perform the binding operation refers to, for example, an instruction for performing the binding operation on the same edge portion of a sheet S by both the stapler 40 and the needleless binding device 50, and an instruction for performing the binding operation on edge portions at respective opposite positions of the sheet S by the stapler 40.

If, in Step S106, the controller 80 determines that the instruction is one indicating that it is not appropriate to perform the binding operation, the controller 80 gives an instruction to the user interface 90 to generate an output indicating that the binding position is not proper (Step S113). In this case, the image forming system 1 does not perform an image forming operation (described later).

In contrast, if, in Step S106, the controller 80 determines that the instruction is one indicating that it is appropriate to perform the binding operation, the controller 80 uses the tables shown in FIGS. 10 and 11 to determine whether or not it is possible to perform the binding operation and the image forming operation of the instruction, received from the user, by the image forming system 1 according to the exemplary embodiment (in particular, the sheet supplying section 6 in the exemplary embodiment) (Step S107).

As mentioned above, if, in Step S107, the controller 80 determines that it is possible to perform the operations, the controller 80 outputs image data to the image forming section 5 (Step S108), outputs to the sheet supplying section 6 a driving signal for driving either the first sheet supplying loading section 61 and the second sheet supplying loading section 62 (Step S109), outputs a driving signal for driving the sheet reversing device 7 if necessary (Step S110), outputs to the stapler 40 a driving signal regarding, for example, where the binding operation is to be performed and the number of sheets S to be bound (Step S111), and outputs to the needleless binding device 50 a driving signal regarding where the binding operation is to be performed and the number of sheets S to be bound (Step S112). Further, although not shown in FIG. 9 for the sake of clarification, the controller 80 also outputs driving signals to, for example, the paddle 37 and the tamper 38.

If, in Step S107, the controller 80 determines that it is not possible to perform the operations, the controller 80 gives an instruction to the user interface 90 to generate an output indicating that it is impossible to perform the instructed image forming operation and binding operation (Step S113). In this case, the image forming system 1 does not perform the image forming operation (described later).

Next, the operation of the image forming system 1 after the controller 80 outputs, for example, the signals to respective structural portions of the image forming system 1 when the controller 80 determines that it is possible to perform the image forming operation and the binding operation will be described.

The operation of the image forming system 1 will be hereunder be described with reference to a case in which a sheet S having an image formed thereon is supplied to the compiling stacking section 35 in a mode shown in FIG. 5C, that is, in a mode in which the top edge portion Sa of the sheet S is disposed at a side of the end guide edge portion Ta, the left edge portion Sb of the sheet S is disposed at a side of the side guide edge portion Tb, and the back surface of the sheet S contacts the bottom portion 35*a* of the compiling stacking section 35. Here, three sheets S are used in a bundle.

First, prior to forming a toner image on a first sheet S by the image forming section 5 of the image forming device 2, the controller 80 causes the stapler 40 to be disposed at the home position (that is, at the position 40*c* in FIG. 3), and the needleless binding device 50 to be disposed at the home position (that is, at the position 50*c* in FIG. 3).

The sheet supplying section 6 that receives a driving signal from the controller 80 supplies the sheets S towards the image forming section 5. More specifically, either the first sheet supplying loading section 61 or the second sheet supplying loading section 62 that receives the instruction supplies the sheets S towards the image forming section 5. In the exemplary embodiment, the sheets S are supplied from the first sheet supplying loading section 61.

Next, the image forming section 5 of the image forming device 2 forms the toner image on the first sheet S supplied from the first sheet supplying loading section 61. In FIG. 1, in the sheet S that passes the upper side of the image forming section 5 to have the image formed thereon and that passes above the image forming section 5, the surface facing the image forming section 5, that is, the lower surface in FIG. 1 is the front surface. The toner image is formed on the sheet S by the image forming section 5 so that the front edge portion in a transport direction of the sheet S is the bottom edge portion Sc, and the back edge portion in the transport direction is the top edge portion Sa.

If necessary, the first sheet S on which the toner image is formed is reversed by the sheet reversing device 7. In the exemplary embodiment, the sheet S is not reversed by the sheet reversing device 7. If the sheet S is reversed, the back surface and the front surface of the sheet S are reversed, and the front edge portion and the back edge portion in the transport direction of the sheet S are also reversed.

Thereafter, the sheets S on which the images are formed are supplied one at a time to the sheet processing device 3 through the discharge rollers 9.

In the transporting device 10 of the sheet processing device 3 to which the first sheet S is supplied, the first sheet S is received through the entrance rollers 11, and, if necessary, holes are formed in the first sheet S with the puncher 12. Thereafter, the first sheet S is transported downstream towards the postprocessing device 30 through the first transporting rollers 13 and the second transporting rollers 14.

The postprocessing device 30 receives the first sheet S through the receiving rollers 31. The first sheet S that passes through the receiving rollers 31 is transported along the first traveling direction S1 by the exit rollers 34. The front edge in the first traveling direction S1 of the first sheet S passes between the compiling stacking section 35 and the paddle 37, after which the paddle 37 moves downward (in the direction of arrow U1 in FIG. 2) and contacts the first sheet S.

Rotation in the direction of arrow R of the paddle 37 shown in FIG. 2 causes the first sheet S to be pushed in the second traveling direction S2 in FIG. 2. Therefore, since the sheet S is transported in the second traveling direction S2 that is opposite to the first traveling direction S1, the front edge portion and the back edge portion in the transport direction of the sheet S are reversed.

Then, the top edge portion Sa of the first sheet S contacts the end guide 35*b*. Thereafter, the paddle 37 is raised (that is, moves in the direction of arrow U2 in FIG. 2). Thereafter, the tamper 38 is driven, and pushes the right edge portion Sd of first sheet S, as a result of which the left edge portion Sb of the first sheet S comes into contact with the side guide 35*c*.

A second sheet S and a third sheet S which follow the first sheet S and on which toner images are formed by the image forming section 5 have their edge portions aligned by the paddle 37 and the damper 38 when they are successively supplied to the postprocessing device 30. By this, the three sheets S, the number of which is previously set, are held in the compiling stacking section 35, and have their edge portions aligned, so that a bundle of sheets S is formed.

Next, the edge portions of the bundle of sheets S stacked on the compiling stacking section 35 are bound.

First, the stapler 40 is moved from the home position (that is, the position 40*c* in FIG. 3), and is disposed at a position where a wire staple 41 is pushed in. At this position, one wire staple 41 is pushed into the bundle of sheets S, so that edge portions of the bundle of sheets S is bound.

Thereafter, the needleless binding device 50 is moved from the home position (that is, the position 50*c* in FIG. 3), and is disposed at a position where an embossed portion 51 is formed. At this position, the upper pressing portion 52*a* and the lower pressing portion 52*b* of the needleless binding device 50 move toward each other, so that the protruding portion 53*a* and the receiving portion 53*b* sandwich the bundle of sheets S and engage each other. This causes an embossed portion 51 to be formed in each sheet S, and the edge portions of the bundle of sheets S to be bound. The embossed portions 51 are formed in all of the three sheets S that are stacked upon each other. The sheets S that are stacked upon each other are pressed into each other, to bind the bundle of sheets S. The bundle of sheets S are in a pressure-bonded state.

Thereafter, the bundle of sheets S that are bound by the embossed portions 51 and the wire staple 41 is rotated by the first eject roller 39*a*, so that the bundle moves from the compiling stacking section 35 to the stacker 70 through the opening 69.

The basic operation mode of the image forming system 1 is as described above. Next, a detailed operation mode of the image forming system 1 will be described with reference to FIGS. 1 to 9.

Mode of Binding Bundle of Sheets S

First, that the bundle of sheets S is capable of being subjected to various modes of binding operations by the postprocessing device 30 according to the exemplary embodiment will be described with reference to FIGS. 6(1) to 7(24). Here, in FIGS. 6(1) to 7(24), wire staples 41 shown by black rectangles indicate the locations where the bundle of sheets S is bound by the stapler 40, and the embossed portions 51 shown by white rectangles indicate the locations where the bundle of sheets S is bound by the needleless binding device 50. FIGS. 6(1) to 7(24) exemplify cases in which the bundle of sheets S is bound at one location by a stapling operation and at one location by a needleless binding operation.

Here, first, a bundle of sheets S having vertically long images formed thereon shown in each of FIGS. 6(1) to 6(12) will be described. The bundle of sheets S shown in FIG. 6(1) will be taken as an example. In the bundle of sheets S, a wire staple 41 is disposed in the top edge portion Sa, which is one of the short-side edge portions of the sheet S, and an embossed portion 51 is disposed at the bottom edge portion Sc, which is the other short-side edge portion of the sheet S. In the bundle of sheets S, the wire staple 41 and the embossed portion 51 are disposed at the short-side edge portions of the sheet S that are opposite to each other.

In bundles of sheets S shown in FIGS. 6(2) to 6(12), wire staples 41 and embossed portions 51 are disposed at different edge portions of the bundles of sheets S.

In bundles of sheets S on which horizontally long images are formed shown in FIGS. 7(13) to 7(24), wire staples 41 and embossed portions 51 are similarly disposed at different edge portions of the sheets S.

Here, comparing an unbinding force of a wire staple 41 and an unbinding force of an embossed portion 51, the unbinding force of the wire staple 41 is larger than the unbinding force of the embossed portion 51. Therefore, when the wire staple 41 and the embossed portion 51 are both used for one bundle of sheets S, for example, the bundle of sheets S is bound so that it is more reliably bound by the wire staple 41, and more easily unbound at the embossed portion 51 (that is, the sheets S are capable of being more easily separated from each other). Here, it is desirable to make it easy to unbound the bound bundle of sheets S in, for example, the following cases: when performing a temporary binding operation in which it is assumed that edge portions of a bundle of sheets S, such as a booklet containing examination questions, are unbound; and when it is necessary to indicate that the bundle of sheets S is unopened.

Relationship Between Orientation of Sheet S and Compiling Stacking Section 35

With reference FIGS. 6(1) to 7(24), it is explained above that various modes of binding operations are capable of being performed on a bundle of sheets S by the image forming system 1 according to the exemplary embodiment.

However, since, as discussed above, the movable range of the stapler 40 (refer to the double-headed arrow A in FIG. 3) and the movable range of the needleless binding device 50 (refer to the double-headed arrow B in FIG. 3) are limited, the image forming system 1 according to the exemplary embodiment performs the following operations. That is, if necessary, the image forming system 1 changes the orientation of an image to be formed on a sheet S, and performs an image forming operation. Further, if necessary, the image forming system 1 performs an image forming operation on a sheet S that is set in a different orientation. This is described with reference to FIGS. 8A to 8H. Here, although the image forming operations are described for the case in which vertically long images are formed on sheets S such as that shown in FIG. 5A, the description also applies to the case in which horizontally long images are formed.

First, sheets S are shown in FIGS. 8A to 8H as being viewed from above the compiling stacking section 35 (that is, in the direction of arrow III in FIG. 2). The sheets S supplied to the compiling stacking section 35 are shown with reference to the transport direction towards the left in FIGS. 8A to 8H, that is, in the transport direction along the direction of arrow S2.

FIGS. 8A to 8D show a face-up state, in which colored letters A are images formed at a front side in a sheet plane of FIGS. 8A to 8D. In contrast, FIGS. 8E to 8H show a face-down state, in which the letters A shown by broken lines are images formed at a back side in a sheet plane of FIGS. 8E to 8H.

Figures 8A, 8B, 8C, 8D, 8E, 8F, 8G, 8H:
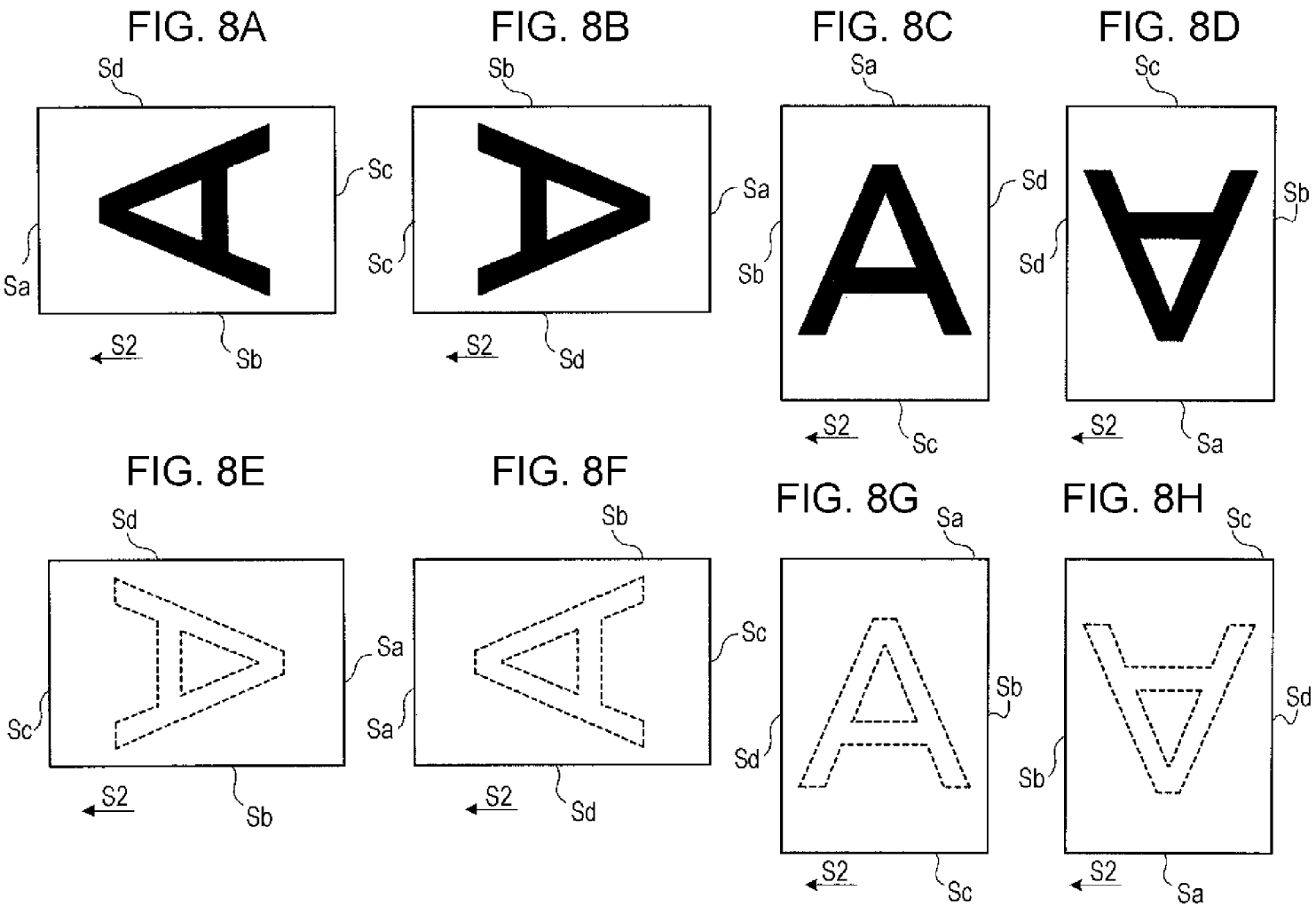
FIGS. 8A to 8H are conceptual views illustrating orientations of images formed on sheets supplied to the compiling stacking section, with FIGS. 8A to 8D illustrating a face-up state, and FIGS. 8E to 8H illustrating a face-down state.
Figure 9:
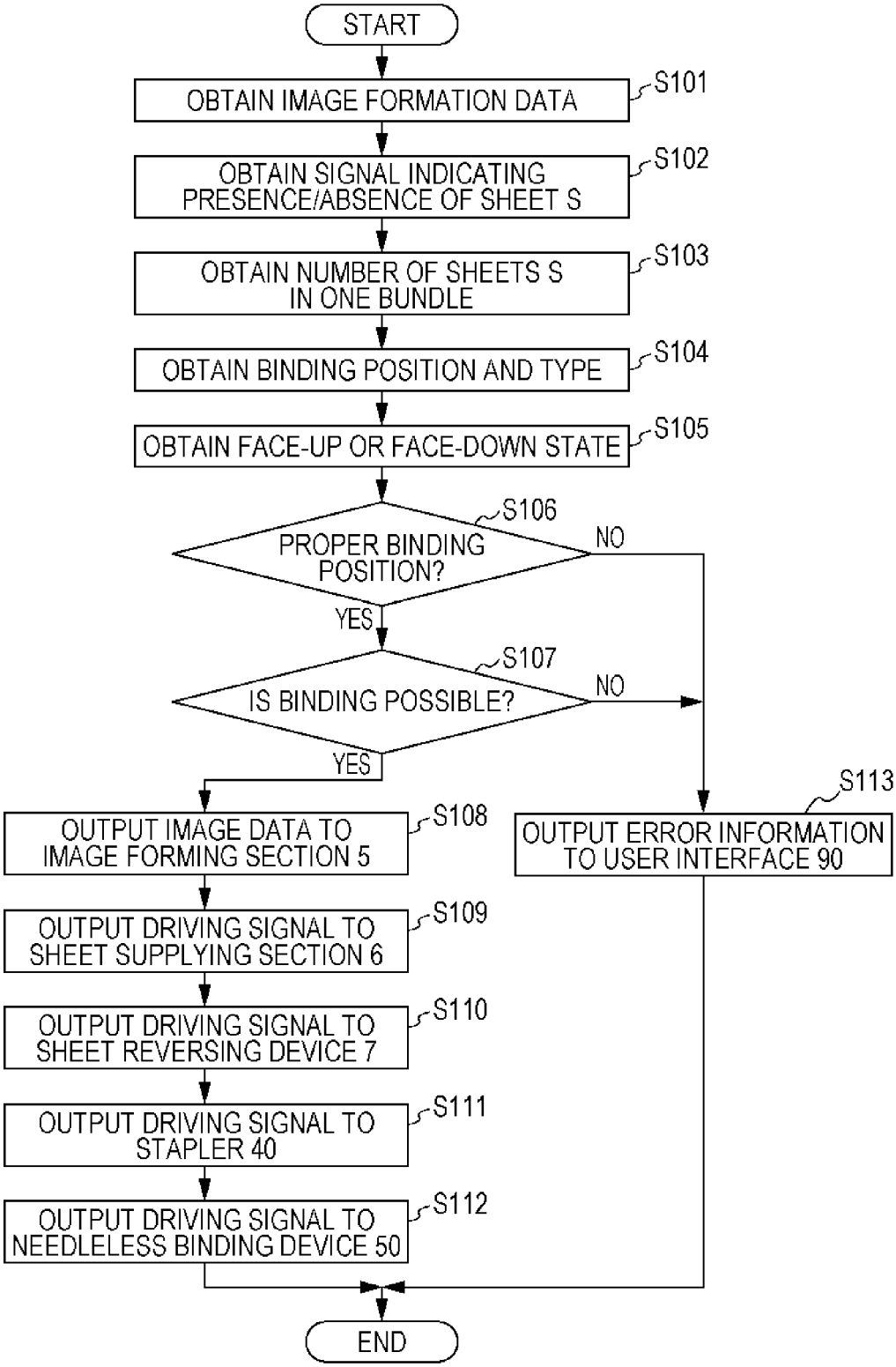
FIG. 9 is a flowchart illustrating the steps of setting a binding operation and an image forming operation by a controller.

In the modes of the images and sheets S discussed in the description of the basic operation of the above-described image forming system 1, that is, when a sheet S oriented so that one of its short sides is a front edge in the transport direction is transported, when an image is formed on the sheet S by the image forming section 5 so that the front edge in the transport direction of the sheet S becomes the top edge portion Sa, and when the sheet S is transported to the compiling stacking section 35 without driving the sheet reversing device 7 (for convenience's sake, hereunder, referred to as "basic sheet supply mode"), the sheet S is supplied in the state shown in FIG. 8A.

Here, in the basic sheet supply mode, as mentioned above, the image forming section 5 forms an image so that the front edge in the transport direction of the sheet S becomes the top edge portion Sa. Accordingly, in detail, first, when a sheet S is supplied to the compiling stacking section 35, the transport direction of the sheet S changes from the first traveling direction S1 to the second traveling direction S2. Therefore, in the basic sheet supply mode, the image forming section 5 successively forms the image from the bottom edge portion Sc of the sheet S towards the top edge portion Sa of the sheet S.

With the rotational angle of the image formed by the image forming section 5 in the basic sheet supply mode being 0 degrees (see FIG. 8A), when images shown in FIGS. 8B to 8D are to be formed, the rotational angles of the images shown in FIGS. 8B to 8D that are rotated in the clockwise direction when the sheets S are viewed from the image forming section 5 are 180 degrees for the image shown in FIG. 8B, 90 degrees for the image shown in FIG. 8C, and 270 degrees for the image shown in FIG. 8D.

Here, first, FIGS. 8A to 8D showing the state in which the images are formed in the face-up state will be described. Then, FIGS. 8E to 8H showing the state in which the images are formed in the face-down state will be described.

First, FIGS. 8A to 8D will be described.

(FIG. 8A) 0 Degrees

The orientation of the sheet S and the image is one in the basic sheet supply mode in the exemplary embodiment. The top edge portion Sa of the sheet S is disposed at the side of the end guide edge portion Ta (the front edge in the second traveling direction S2), and the left edge portion Sb of the sheet S is disposed at the side of the side guide edge portion Tb (lower side in the figure), to transport the sheet S. In the basis sheet supply mode, the sheet S is transported with a short side of the sheet S being the front edge in the second traveling direction S2.

(FIG. 8B) 180 Degrees

The image is formed in a state in which it is rotated by 180 degrees from the state of the basic sheet supply mode in the exemplary embodiment. The bottom edge portion Sc of the sheet S is disposed at the side of the end guide edge portion Ta (the front edge in the second traveling direction S2), and the right edge portion Sd of the sheet S is disposed at the side of the side guide edge portion Tb (lower side in the figure), to transport the sheet S. In the exemplary embodiment, the sheet S is transported with a short side of the sheet S being the front edge in the second traveling direction S2. This point is common to the basic sheet supply mode.

(FIG. 8C) 90 Degrees

The image is formed in a state in which it is rotated by 90 degrees from the state of the basic sheet supply mode in the exemplary embodiment. The left edge portion Sb of the sheet S is disposed at the side of the end guide edge portion Ta (the front edge in the second traveling direction S2), and the bottom edge portion Sc of the sheet S is disposed at the side of the side guide edge portion Tb (lower side in the figure), to transport the sheet S. In the exemplary embodiment, the sheet S is transported with a long side of the sheet S being the front edge in the second traveling direction S2.

(FIG. 8D) 270 Degrees

The image is formed in a state in which it is rotated by 270 degrees from the state of the basic sheet supply mode in the exemplary embodiment. The right edge portion Sd of the sheet S is disposed at the side of the end guide edge portion Ta (the front edge in the second traveling direction S2), and the top edge portion Sa of the sheet S is disposed at the side of the side guide edge portion Tb (lower side in the figure), to transport the sheet S. In the exemplary embodiment, the sheet S is transported with a long side of the sheet S being the front edge in the second traveling direction S2.

Next, FIGS. 8E to 8H showing states in which images are in a face-down state will be described. Since the images are formed in the face-down state, in the modes shown in FIGS. 8E to 8H, the sheet reversing device 7 is driven to reverse the front surfaces and the back surfaces of the sheets S, after which the sheets S are transported to the compiling stacking section 35.

(FIG. 8E) 0 Degrees

As in the basic sheet supply mode in the exemplary embodiment, an image angle is 0 degrees. As described above, by driving the sheet reversing device 7, the front surface and the back surface of the sheet S are the reverse of those in the basic sheet supply mode. As a result, with the left edge portion Sb and the right edge portion Sd of the sheet S being the reverse of those in the basic sheet supply mode, the top edge portion Sa of the sheet S is disposed at the side of the end guide edge portion Ta (the front edge in the second traveling direction S2), and the right edge portion Sd of the sheet S is disposed at the side of the side guide edge portion Tb (the lower side in the figure).

(FIGS. 8F to 8H)

In other modes, image angles are 180 degrees (FIG. 8F), 90 degrees (FIG. 8G), and 270 degrees (FIG. 8H). As in FIGS. 8A to 8D, from the state in FIG. 8E, the images are formed by being rotated by 180 degrees, 90 degrees, and 270 degrees, respectively, after which the sheets S are supplied to the compiling stacking section 35.

Accordingly, it becomes possible to supply the sheets S to the compiling stacking section 35 with the dispositions of the respective edge portions of the sheets S being changed by rotating the images. Although not illustrated in FIGS. 8A to 8H, this makes it possible to change the edge portions that are bound by the needleless binding device 50 and the stapler 40 provided in the vicinity of the compiling stacking section 35.

Conditions for Image Forming Operation and Sheet Binding Operation

Next, with reference to FIGS. 10 and 11, the case in which binding of the bundles of sheets S shown in FIGS. 6(1) to FIGS. 7(24) are executed will be described. The contents shown in FIGS. 10 and 11 are stored in a storage section (not shown) of the controller 80. On the basis of the contents, the controller 80 determines whether or not it is possible to perform the image forming operation and the binding operation of the instructions received by a user. If the controller 80 determines that it is possible to perform the image forming operation and the binding operation, the controller 80, for example, outputs driving signals to respective structural portions on the basis of the contents.

Here, in FIGS. 10 and 11, the symbols correspond to the numbers of the bundles of sheets S in parenthesis in FIGS. 6(1) to 7(24). The conditions for binding the bundles of sheets S corresponding to the symbols are given in respective columns of FIGS. 10 and 11.

More specifically, the STAPLE and EMBOSS columns indicate the edge portions of the sheets S where the wire staples 41 and the embossed portions 51 are disposed. In these columns, "TOP" indicates that the top edge portion Sa is bound, "BOTTOM" indicates that the back edge portion Sc is bound, "LEFT" indicates that the left edge portion Sb is bound, and "RIGHT" indicates that the right edge portion Sd is bound.

Next, the SHEET S column indicates the direction in which the sheets S are transported. "Long Edge Feed (LEF)" indicates that the sheets S are transported in the direction in which one long side of the sheets S is a front edge (that is, in the direction in which the sheets S are transported along a short side of the sheets S). "Short Edge Feed (SEF)" indicates that the sheets S are transported in the direction in which one short side of the sheets S is a front edge (that is, in the direction in which the sheets S are transported along a long side of the sheets S.

The ROTATIONAL ANGLE column indicates the angles of the images formed by the image forming section 5. They are 0 degrees, 180 degrees, 90 degrees, and 270 degrees in the clockwise direction when viewing the sheets S from the image forming section 5.

The REVERSAL column indicates whether or not there is a reversing step of the sheet reversing device 7.

The STAPLING POSITION (Ta OR Tb) column indicates edge portions of the bottom portion 35*a* of the compiling stacking section 35 at which the stapler 40 performs a binding operation. "Ta" denotes the end guide edge portion, and "Tb" denotes the side guide edge portion.

The EMBOSS POSITION (Tc OR Td) column indicates edge portions of the bottom portion 35*a* of the compiling stacking section 35 at which the needleless binding device 50 performs a binding operation. "Tc" denotes the opposing end guide edge portion, and Td denotes the opposing side guide edge portion.

The SEF & LEF column under the SHEET SUPPLYING SECTION column indicates that it is possible to supply the sheets S in both transport directions, an SEF direction and an LEF direction. In the exemplary embodiment, the first sheet supplying loading section 61 and the second sheet supplying loading section 62 are capable of holding interiors thereof sheets S having the same size and oriented in directions that differ by 90 degrees in the transport direction of the sheets S. The SEF & LEF column more specifically indicates that the first sheet supplying loading section 61 and the second sheet supplying loading section 62 of the sheet supplying section 6 hold the sheets S in the interiors thereof.

In contrast, the ONLY SEF column and the ONLY LEF column indicate that it is possible to supply the sheets S only in the SEF direction and only in the LEF direction, respectively, such as when the sheets S that are supplied in the LEF direction are used up.

Further, ○ indicates that it is possible to execute an image forming operation under particular conditions; and that the image forming operation under these conditions is preferentially selected. Δ indicates that it is possible to execute an image forming operation under particular conditions, and that the image forming operation under these conditions is not preferentially selected.

Here, a detailed description will be given with reference to the case indicated by symbol (1).

In the case indicated by symbol (1), as shown in FIG. 6(1), the staple wire 41 is disposed at the top edge portion Sa, and the embossed portion 51 is disposed at the bottom edge portion Sc.

First, when the sheet reversing device 7 is provided in the image forming device 2, and it is possible to supply the sheets S in the SEF direction and the LEF direction, a user refers to the SEF & LEF column under the SHEET SUPPLYING SECTION column. Δ is placed in the SEF & LEF column in the row corresponding to SEF for sheets used. In contrast, ○ is placed in the SEF & LEF column in the row corresponding to LEF for sheets used. As mentioned above, since the image forming operation under the conditions indicated for ○ is given priority, transportation of the sheets used in the LEF direction, that is, in the direction in which one long side of the sheets S is the front edge, is selected. The image-formation angle in this case is 270 degrees, and the REVERSAL column indicates "NO", as a result of which the sheets S are not reversed by the sheet reversing device 7. In addition, the position where the wire staple 41 is disposed is Ta, and the position where the embossed portion 51 is disposed is Tc.

In contrast, when, under the same conditions, the sheets S are supplied only in the SEF direction or only in the LEF direction, one ○ each is placed in the ONLY SEF column and in the ONLY LEF column. Accordingly, the conditions in the row indicated for ○ are selected.

Here, the conditions shown in FIGS. 10 and 11 are determined as follows. First, the case in which the sheets S after the image forming operation are not reversed is given priority over the case in which the sheets S after the image forming operation are reversed. This is for suppressing a reduction in productivity. If it is possible to supply the sheets S in both the SEF direction and the LEF direction, the supply of the sheets S in the LEF direction is given priority. This is for suppressing a reduction in productivity.

As discussed above, in the image forming system 1 according to the exemplary embodiment, the movable range of the stapler 40 (refer to the double-headed arrow A in FIG. 3) and the movable range of the needleless binding device 50 (refer to the double-headed arrow B in FIG. 3) are limited. However, as shown in FIGS. 10 and 11, the image forming operation is performed by changing the orientations of the images to be formed on the sheets S, and, if necessary, the image forming operation is performed on the sheets S that are oriented differently, so that it is possible to bind a bundle of sheets S in various modes.

In the foregoing description, the formation of images in the face-up state and the face-down state is described.

The order in which the images are formed on sheets S when the controller 80 selects the formation of images in the face-up state differs from the order in which the images are formed on sheets S when the controller 80 selects the formation of images in the face-down state.

For example, when the images formed on the sheets (1 to N) are read by a reading unit (such as a scanner) (not shown), the scanner reads the images in the order in which the sheets S are supplied to the scanner (here, in the order of from 1 to N). Then, when the images are formed in the face-up state on the basis of the read images, the controller 80 outputs image data so that the images are formed on the sheets S in the order of from 1 to N by the image forming section 5.

In contrast, when the images are to be formed in the face-down state, the front surfaces and the back surfaces of the sheets S stacked upon the compiling stacking section 35 are reversed, as a result of which the controller 80 outputs image data so that the order of the images to be formed by the image forming section 5 are reversed, and the images are formed in the reverse order. In the above-described exemplary embodiment, the controller 80 outputs the image data to the image forming section 5 so that toner images are formed in the order of from N to 1.

Here, the case in which the images are to be formed in the face-down state will be described. When the images are to be formed in the face-down state, the conditions in the rows indicating "YES" under the REVERSAL column in each of FIGS. 10 and 11 are selected.

For example, for the conditions for the symbol (1) in FIG. 10, that is, for the case in which the STAPLE column indicates "TOP", and the EMBOSS column indicates "BOTTOM", "NO" is given in the rows under the REVERSAL column. Here, the conditions in FIGS. 10 and 11 are similarly set. That is, with the rows under the REVERSAL column indicating "YES", the image forming operation under the condition in which the sheet reversing device 7 is driven is performed.

More specifically, when the SHEET S column indicates "LEF", the ROTATIONAL ANGLE)(°) column indicates 270, the STAPLING POSITION (Ta OR Tb) column indicates Ta, the EMBOSS POSITION (Tc OR Td) column indicates Tc, the SEF & LEF column under the SHEET SUPPLYING SECTION column indicates ○, the ONLY SEF column under the SHEET SUPPLYING SECTION column indicates –, and the ONLY LEF column under the SHEET SUPPLYING SECTION column indicates ○.

The other conditions, such as the conditions for (4), (7), and (10) in FIG. 10 are similarly determined.

Although, in the above-described exemplary embodiment, the case in which, when the face-up state and the face-down state are selected, the images are formed on the sheets S in the reverse order is described, the present invention is not limited thereto. For example, it is possible to form the toner images in the order in which the images are read by a scanner, and to physically reverse the order of the sheets S when transporting the sheets S. More specifically, it is possible to stock sheets S having images formed thereon in an intermediate stacking section (not shown) provided in the image forming system 1, and to successively supply the sheets S of a bundle to the compiling stacking section 35 when the sheets S are stocked.

Here, as shown in FIG. 1, in the exemplary embodiment, in a sheet S that passes the upper side of the image forming section 5 to have an image formed thereon and that passes above the image forming section 5, the surface facing the image forming section 5, that is, the lower surface in FIG. 1 is the front surface. However, the present invention is not limited thereto. For example, in addition to the image forming section 5 shown in FIG. 1, that is, the image forming section 5 that forms an image onto a sheet S that passes the upper side of image forming section 5, an image forming section 5 that is provided opposite to the passing sheet S, that is, above the passing sheet S may be provided. This structure makes it possible to form images on both the upper surface and the lower surface of the passing sheet S.

Although, in the exemplary embodiment, the sheet reversing device 7 is described as being provided in the image forming device 2, the present invention is not limited thereto. That is, the sheet reversing device 7 may be disposed anywhere as long as it is disposed downstream from the image forming section 5 in the transport direction of the sheets S, and upstream from the compiling stacking section 35 in the transport direction of the sheets S. For example, the sheet reversing device 7 may be set in the sheet processing device 3.

In addition, the stapler 40 is formed so as to be capable of performing stapling at two edge portions (the end guide edge portion Ta and the side guide edge portion Tb) of the bottom portion 35*a* of the compiling stacking section 35, and the needleless binding device 50 is formed so as to be capable of binding a bundle of sheets S at two other edge portions (the opposing end guide edge portion Tc and the opposing side guide edge portion Td) of the bottom portion 35*a* of the compiling stacking section 35. However, the present invention is not limited thereto. That is, it is possible to allow the stapler 40 to be disposed at one edge portion (such as the end guide edge portion Ta) of the bottom portion 35*a* of the compiling stacking section 35, and allow the needleless binding device 50 to be disposed at the other three edge portions (such as the side guide edge portion Tb, the opposing end guide edge portion Tc, and the opposing side guide edge portion Td). Further, it is possible to fix the stapler 40 at only corners of the bottom portion 35*a* of the compiling stacking section 35, and to allow the needleless binding device 50 to be disposed at the edge portions.

Further, although, here, the bundle of sheets S shown in each of FIGS. 6(1) to 7(24) is discussed, these bundles of sheets S are merely examples. The postprocessing device 30 in the exemplary embodiment is capable of operating in binding modes other than the aforementioned binding modes of the bundles of sheets S. For example, it is possible for the postprocessing device 30 to operate in a mode in which each corner of a bundle of sheets S is bound, or to change the locations where the bundle of sheets S is bound and the number of binding locations. Further, for example, it is possible for the postprocessing device 30 to operate in a mode in which the bundle of sheets S is bound by only disposing the wire staples 41 or in a mode in which the bundle of sheets S is bound by only performing an embossing operation.

Further, although, in the foregoing description, the stapler 40 is used as a first binding unit and the needleless binding device 50 is used as a second binding unit, the present invention is not limited to the exemplary embodiment. For example, the first and second binding units may be the same type of binding units. That is, the first binding unit may be a binding unit that performs binding with first wire staples, and the second binding unit may be a binding unit that performs binding with second wire staples that have less unbinding force than the first wire staples. Similarly, both of the first and second binding units may be needleless binding units, or may be other types of binding units, such as binding units using adhesives.

Further, in the above-described exemplary embodiment, the mode in which sheets S are supplied in the face-up state while, for convenience sake, one short side of each sheet S is disposed at the front side in the transport direction and without driving the sheet reversing device 7 is described as the basic sheet supply mode. However, the present invention is not limited thereto. For example, a mode in which one long side of each sheet S is disposed at the front side in the transport direction may be the basic sheet supply mode (refer to FIGS. 8C and 8D. In this case, the number of sheets on which images are formed per unit time is increased. In addition, the face-down state may be the basic state instead of the face-up state. The face-down state is desirable from the viewpoint of information management because the surfaces of the sheets S on which images are formed are faced downward and discharged to the stacker 70.

Further, the following device may be used as the needleless binding device 50.

Figure 12A:
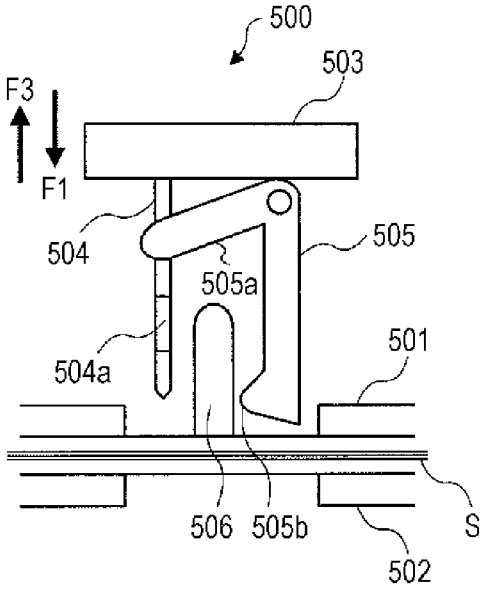
FIGS. 12A to 12D illustrate another exemplary structure of a needleless binding device and a bundle of sheets subjected to a needleless binding operation.

FIGS. 12A to 12D illustrate another exemplary structure of a needleless binding device 500 and a bundle of sheets S subjected to a needleless binding operation. As shown in FIG. 12A, the needleless binding device 500 binds the bundle of sheets S with a mechanism described below by pushing a base section 503 in the direction of arrow F1 in FIG. 12A, with the bundle of sheets S being interposed between a base 501 and a bottom member 502.

Figure 12B:
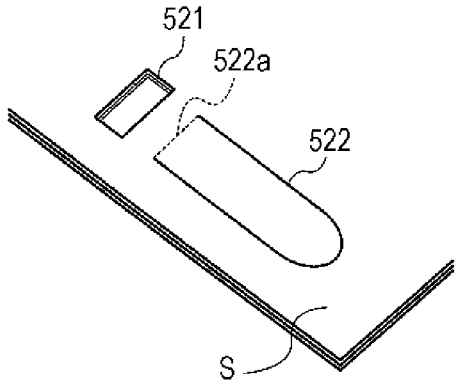
Figure 12C:
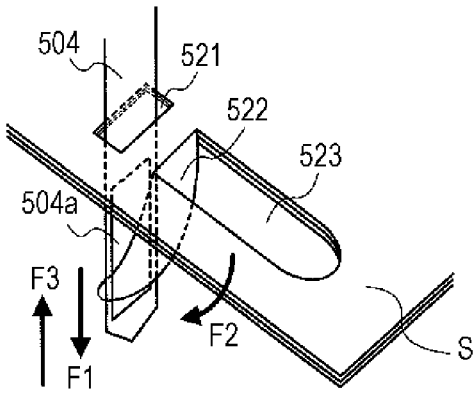
Figure 12D:
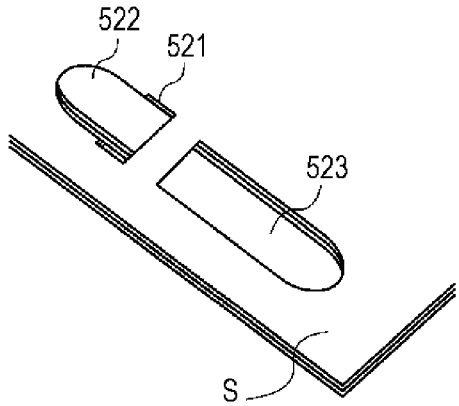

More specifically, first, when a plate 504 and a punching member 505 pass through the bundle of sheets S, as shown in FIG. 12B, a slit 521 and a tongue 522 are formed in the bundle of sheets S. The tongue 522 is formed by punching a portion of the bundle of sheets S with an edge portion 522*a* kept attached to the bundle of sheets S. When the base section 503 is further pushed, an upper edge portion 505*a* of the punching member 505 strikes a protrusion 506 integrally formed with the base 501, so that the punching member 505 rotates clockwise in FIG. 12A. By this, as shown in FIG. 12C, a protrusion 505*b* at an end of the punching member 505 causes the tongue 522 to be pushed into an eyelet 504*a* of the blade 504 in the direction of arrow F2 in FIG. 12C. In FIG. 12C, the punching member 505 is not shown. When, in this state, the base section 503 is raised in the direction of arrow F3 in FIG. 12C, the blade 504 is raised with the tongue 522 caught in its eyelet 504*a*. Then, as shown in FIG. 12D, the tongue 522 is inserted into the slit 521, to bind the bundle of sheets S. A binding hole 523 is formed in the bundle of sheets S at this time where the tongue 522 is punched from the bundle of sheets S.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

a first supplying unit that supplies a plurality of recording materials in a first orientation, each recording material having a long side and a short side, the first orientation being an orientation in which the short side is a front side in a transport direction;

a second supplying unit that supplies a plurality of recording materials in a second orientation, each recording material having a long side and a short side, the second orientation being an orientation in which the long side is a front side in the transport direction;

an image forming unit that forms images on the plurality of recording materials supplied from the first supplying unit or the second supplying unit;

a stacking unit that is used to stack, as a bundle, the plurality of recording materials having the images formed thereon by the image forming unit, the bundle having the plurality of recording materials placed upon each other with first edge portions and second edge portions, differing from the first edge portions, of the respective recording materials being aligned with each other;

a first binding unit that binds, by a first binding operation, the first edge portions of the bundle of the plurality of recording materials stacked upon the stacking unit;

a second binding unit that binds, by a second binding operation, the second edge portions of the bundle of the plurality of recording materials stacked upon the stacking unit;

an obtaining unit that obtains an instruction regarding a binding position of the first binding operation and a binding position of the second binding operation with respect to the bundle of the plurality of recording materials; and a controller that performs control to supply the plurality of recording materials from either one of the first supplying unit and the second supplying unit, on the basis of the binding positions of the first and second binding operations obtained by the obtaining unit.

2. The image forming system according to claim 1, wherein the controller causes the plurality of recording materials to be supplied from the second supplying unit when the supply of the plurality of recording materials from the first supplying unit and the supply of the plurality of recording materials from the second supplying unit are both allowed.

3. The image forming system according to claim 1, further comprising a reversing transporting unit that reverses front and back surfaces of the plurality of recording materials having the images formed thereon by the image forming unit, and that transports the reversed plurality of recording materials to the stacking unit, wherein the controller performs control to determine whether or not to cause the reversing transporting unit to reverse and transport the plurality of recording materials, on the basis of orientations of the images with respect to the plurality of recording materials and on the basis of the binding position of the first binding operation and the binding position of the second binding operation.

4. The image forming system according to claim 1, wherein the controller performs control to rotate orientations of the images that the image forming unit forms on the respective recording materials of the bundle of the plurality of recording materials, on the basis of the orientations of the images with respect to the plurality of recording materials and on the basis of the binding position of the first binding operation and the binding position of the second binding operation.

5. The image forming system according to claim 1, wherein the second edge portions bound by the second binding operation using the second binding unit are more easily unbound than the first edge portions bound by the first binding operation using the first binding unit.

6. The image forming system according to claim 5, wherein the controller causes the second binding operation to be performed on the bundle of the plurality of recording materials by the second binding unit after causing the first binding operation to be performed on the bundle of the plurality of recording materials by the first binding unit.

* * * * *